US007357692B2

(12) United States Patent
Klein et al.

(10) Patent No.: US 7,357,692 B2
(45) Date of Patent: Apr. 15, 2008

(54) HISTORIC WOODEN ADVENTURE SYSTEM AND FIGURES

(75) Inventors: Andrew Klein, Westport, CT (US); Ty Eason, Howard Beach, NY (US)

(73) Assignee: Odyssey Toys, Westport, CT (US)

( * ) Notice: Subject to any disclaimer, the term of this patent is extended or adjusted under 35 U.S.C. 154(b) by 0 days.

(21) Appl. No.: 11/384,272

(22) Filed: Mar. 21, 2006

(65) Prior Publication Data

US 2006/0178080 A1 Aug. 10, 2006

Related U.S. Application Data

(62) Division of application No. 10/360,932, filed on Feb. 10, 2003, now Pat. No. 7,147,537.

(60) Provisional application No. 60/354,528, filed on Feb. 8, 2002.

(51) Int. Cl.
*A63J 19/00* (2006.01)

(52) U.S. Cl. ..... 446/82; 472/75

(58) Field of Classification Search ..... 446/83, 446/84, 108, 111, 112, 114, 115; 472/57, 472/75

See application file for complete search history.

(56) References Cited

U.S. PATENT DOCUMENTS

| | | | | |
|---|---|---|---|---|
| 593,592 | A | 11/1897 | Lyons | |
| 984,735 | A * | 2/1911 | Bailey | 446/82 |
| 1,619,719 | A * | 3/1927 | Goldman et al. | 472/75 |
| 2,451,023 | A | 10/1948 | Dusko | |
| D171,367 | S * | 1/1954 | Rollins | D21/506 |
| 3,624,691 | A | 11/1971 | Robson et al. | |
| 3,742,642 | A * | 7/1973 | Zegers-Ten Horn | 434/430 |
| 3,961,426 | A * | 6/1976 | Wallace | 434/73 |
| 4,708,687 | A | 11/1987 | Goldberg et al. | |
| 4,764,142 | A * | 8/1988 | Griffith et al. | 446/82 |
| 4,816,002 | A | 3/1989 | Brodrib | |
| 5,013,278 | A | 5/1991 | Dixon et al. | |
| 5,017,173 | A | 5/1991 | Shapero et al. | |
| 5,205,775 | A | 4/1993 | Brodrib | |
| 5,224,896 | A | 7/1993 | Terzian | |
| 5,542,870 | A | 8/1996 | Westersund | |
| 5,741,140 | A | 4/1998 | Bristol | |
| 6,074,270 | A | 6/2000 | Wilcox et al. | |
| 6,089,949 | A | 7/2000 | Resper et al. | |
| 6,220,922 | B1 | 4/2001 | Lee et al. | |
| 6,237,759 | B1 | 5/2001 | Wotton | |
| 6,638,136 | B1 | 10/2003 | Lee et al. | |
| 2002/0055322 | A1 | 5/2002 | Lee et al. | |
| 2002/0058458 | A1 | 5/2002 | Lee et al. | |

FOREIGN PATENT DOCUMENTS

| | | |
|---|---|---|
| EP | 0582 020 A1 | 9/1994 |

* cited by examiner

*Primary Examiner*—John A. Ricci
(74) *Attorney, Agent, or Firm*—Wilburn L. Chesser

(57) ABSTRACT

Action toys and methods of assembling and using the toys. A first aspect the invention includes assembleable sectioned portions of background play scenes that are easily assembleable and rearrangeable into virtually endless diorama-like arrangements using a specialized connection system that allows any base and backdrop to be connected in multiple orientations. A second aspect of the invention includes specially designed and constructed figures usable with the background scenes. The figures include central body portions from which flexible limbs and head extend and features that allow the figures to free stand and to hold objects.

11 Claims, 25 Drawing Sheets

FIG. 11

Main Features:

- Pretend play scenes with posable figures and vehicles from the historic event.
- Wooden buildings, structures, platforms and backdrops with beautifully illustrated artwork.
- Innovative two-sided backdrops turn around to change scenes.
- Interconnecting platforms and compatible parts form a system letting children easily expand their play area.
- Entertaining functions such as expandable mission control, Apollo Saturn V rocket launches and separates into stages, view from inside Command Module traveling to the moon, Eagle Lunar Module lands on moon and ascent stage returns to Command Module, astronaut figures travel moonscape to collect moon rocks with magnetic feets, plant USA flag, make footprints and take bounding steps in low gravity.
- Sound module embedded in mission control broadcasts voices and sounds associated with each scene.
- Patent Pending

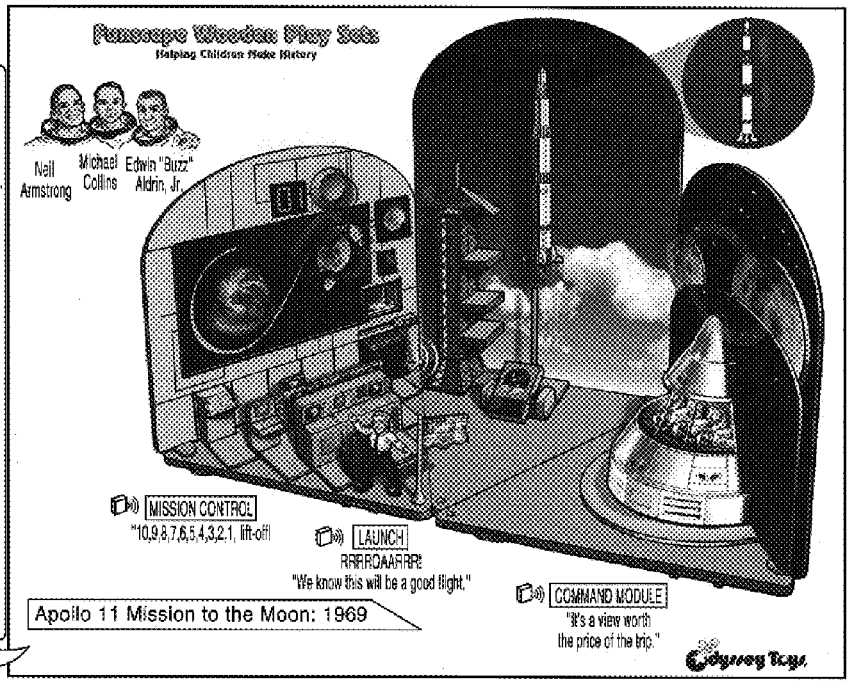

Expand the stage play area by connecting bases together.

Backdrops have attached • reliefsŽ. These are buildings, natural landscape features and other structures.

KEY FEATURES

CONFIGURE IN ANY WAY

EXPAND WITH ANY NUMBER OF BASES AND BACKDROPS

For example:

SECTION C-C

SECTION A-A

SECTION B-B

HISTORIC WOODEN ADVENTURE SYSTEM AND FIGURES

CROSS-REFERENCE TO RELATED APPLICATION

This is a Divisional Application of U.S. patent application Ser. No. 10/360,932 filed Feb. 10, 2003 now U.S. Pat. No. 7,147,537, which claims priority from Provisional Application Ser. No. 60/354,528 filed Feb. 8, 2002. The disclosure of the prior applications is hereby incorporated by reference herein in its entirety.

BACKGROUND OF THE INVENTION

1. Field of the Invention

The present invention relates to the field of toys, and in particular to wooden and plastic toys, in which wooden background portions are fittably attachable so as to form play scenes, and toy figures are provided that include movable and adjustable limbs attached about one or more central flexing points.

2. Background of the Technology

It is known in the art to provide toys that include assembleable portions, such as castles and blocks, and it is also known in the art to provide toy figures for use with such assembleable toys. Further, it is known in the art to provide toys that include figures in conjunction with dioramas, but typically, these toys are overly complex, fragile, or difficult to use, and/or do not allow any variation in the diorama. For example, U.S. Pat. No. 5,013,278 to Dixon, et al., relates to a diorama toy kit in which figures are included in a case that is openable and may be set up into a diorama scene. However, the sections of the case are not disassembleable and easily rearrangeable into varying scenes. Similarly, U.S. Pat. No. 5,542,870 to Westersund presents a folding and unfoldable box that forms a single diorama layout, with which figures are used. While the faces on the diorama of Westersund are snappably replaceable, the box in the closed or open position cannot be easily reconfigured into any variety of scenes, nor is the diorama easily expandable.

There is an unmet need for assembleable background sections with simple to use connectors that allow formation of, reassembly into, and expansion to a wide range of scenes for play. There is also a need for figures that present realistic clothed appearance, but that are simple to manufacture and are rugged, yet allow realistic posing.

SUMMARY OF THE INVENTION

The present invention relates to toys and methods of assembling and using the toys. A first aspect of an embodiment of the present invention includes assembleable sectioned portions of background play scenes, referred to in embodiments of the present invention as "Scapes." A second aspect of the present invention includes specially designed and constructed figures (also referred to interchangeable herein as "dolls" or "action figures") that include central body portions from which bendable/flexible limbs and head extend.

In accordance with one embodiment of the present invention, Scapes sets have interconnecting play boards and changeable, two-sided backdrops with, for example, attached toy structures and vibrant, hand-illustrated scenery. The playboards and background can be constructed of any appropriate material known in the art for toy manufacture, including, but not limited to wood, plastic, cardboard, chipboard, or foam. In one embodiment, the boards and backdrops easily connect to create two play scenes, one on each side of the backdrop. In other embodiments, the scenes are provided only on one side. The sets are easily connected and expanded to create many play scenes, such as on each side of the backdrops.

In one embodiment of the present invention, each set presents a scene made of interconnecting bases of unique geometries, two-sided changeable backdrops with attached structures, and illustrated landscapes. Sets include such figures as posable human figures, animals, alien or fantasy creations, vehicles, and natural objects, which users move around the scene in pretend play. Set backdrops include, for example, buildings with mechanical functions, pop-up doors, nesting sections and hidden compartments.

The innovative two-sided backdrops and interconnecting bases allow users to use their imagination to variably connect the sets in many different ways and expand the play area. Using the same set, users are able to create more than one scene by, for example, reconfiguring the base pieces and by flipping the backdrops, thus converting one landscape into another. Bases, backdrops and components from different sets and accessories all fit together, so by obtaining or otherwise using more products together (e.g., by connecting additional bases and backdrops), users can easily expand any scene. The flipping backdrop and interconnecting expanding base features of the present invention allow users to pretend and create, for example, their own vision of real history.

Usable with the Scapes sets are fully posable figures with, for example, non-removable or optionally changeable clothing, and individually sculpted heads. The figures are specially designed to allow them to free stand, and the human figures include other features, such as gripping hands that allow the figures to hold objects, which enhance play. In one embodiment, many of the figures portray, for example, celebrated historic characters or other representative individuals in a way that is realistic yet playful.

In one embodiment, pairs of limbs are joined at one or more points using, for example, a single peg (also referred to interchangeably herein as a "post") through openings in the ends of the limbs. In another embodiment, some limbs are joined by such peg and openings features, while other limbs and/or the head are joined by specialized socket and flange assemblies. In one embodiment, the limbs have a flexible outer surface, such as soft plastic, and an inner stiffening, bendable, and shape retaining frame, such as wire or other metal, to allow the limbs to be placed in and retain shape in a wide range of bent positions.

Additional advantages and novel features of the invention will be set forth in part in the description that follows, and in part will become more apparent to those skilled in the art upon examination of the following or upon learning by practice of the invention.

BRIEF DESCRIPTION OF THE FIGURES

FIGS. 11 and 12 present a full setup and disassembled layout features, respectively, for example Apollo Moon Scapes, in accordance with an embodiment of the present invention

DETAILED DESCRIPTION

An embodiment of the present invention includes a series of wooden play sets, one portion of which are referred to as "Scapes." The play sets are highly entertaining and wholesome in nature and designed with developmental and educational values in mind. Scapes products provide an open-ended, expandable system that includes a series of play sets crafted, for example, from top quality wood and other materials. Each set depicts scenes made of interconnecting bases, changeable backdrops with attached structures, and illustrated landscapes.

In one embodiment, each set depicts, for example, several scenes from historic events. While the product themes are grounded in reality, the products are designed for pretend play to stimulate the user's imagination. In one embodiment, sets are grouped into different categories, such as United States (U.S.) History, World Exploration, Inventors, Pirates, and Sports. Examples of events in the U.S. History category include the Plymouth Colony, the Gold Rush, and the Lewis and Clark Expedition. Each event is provided, for example, in different size sets, such as starter sets and deluxe sets. In order to allow further virtually unlimited expansion of the sets, the sets are also usable in conjunction with accessories, such as extra figures, add-on buildings, and expansion kits.

An embodiment of the present invention also includes posable human figures, animals, vehicles, and objects that children or other users are able to move around in pretend play. Buildings and structures have, for example, mechanical functions, pop-up doors, and hidden compartments. The innovative backdrops and interconnecting bases allow users to use their imagination to assemble the sets in different ways each time they play, or otherwise use the invention, and to expand the play area. Using the same set, users are able to create more than one scene by reconfiguring the base pieces and backdrops, thereby converting one landscape into another. Bases, backdrops, and components from different sets and accessories all fit together, so by obtaining more products, any scene can be easily expanded. The backdrop and interconnecting expanding base features of Scapes thus allow users to pretend and create their own vision of real history.

FIGS. 1-4 show photostats fo various features of Apollo Moon Scapes and Plymouth Scapes, two example series in the system of the present invention. Other Scapes include, for example, Explorer Scapes, Castle Scapes, and Pirate Scapes. The example Apollo Moon Scapes series features a rocket that manually launches, spacecraft that travel to the moon, a pull-out mission control, and stunning moonscapes where astronauts make footprints on the moon, plant the American flag and collect moon rocks. The Plymouth Scapes series includes a Pilgrim house that folds-out and opens up, magnetic fishing, the Mayflower sailing to Plymouth Rock and the first Thanksgiving feast.

Figure 1:
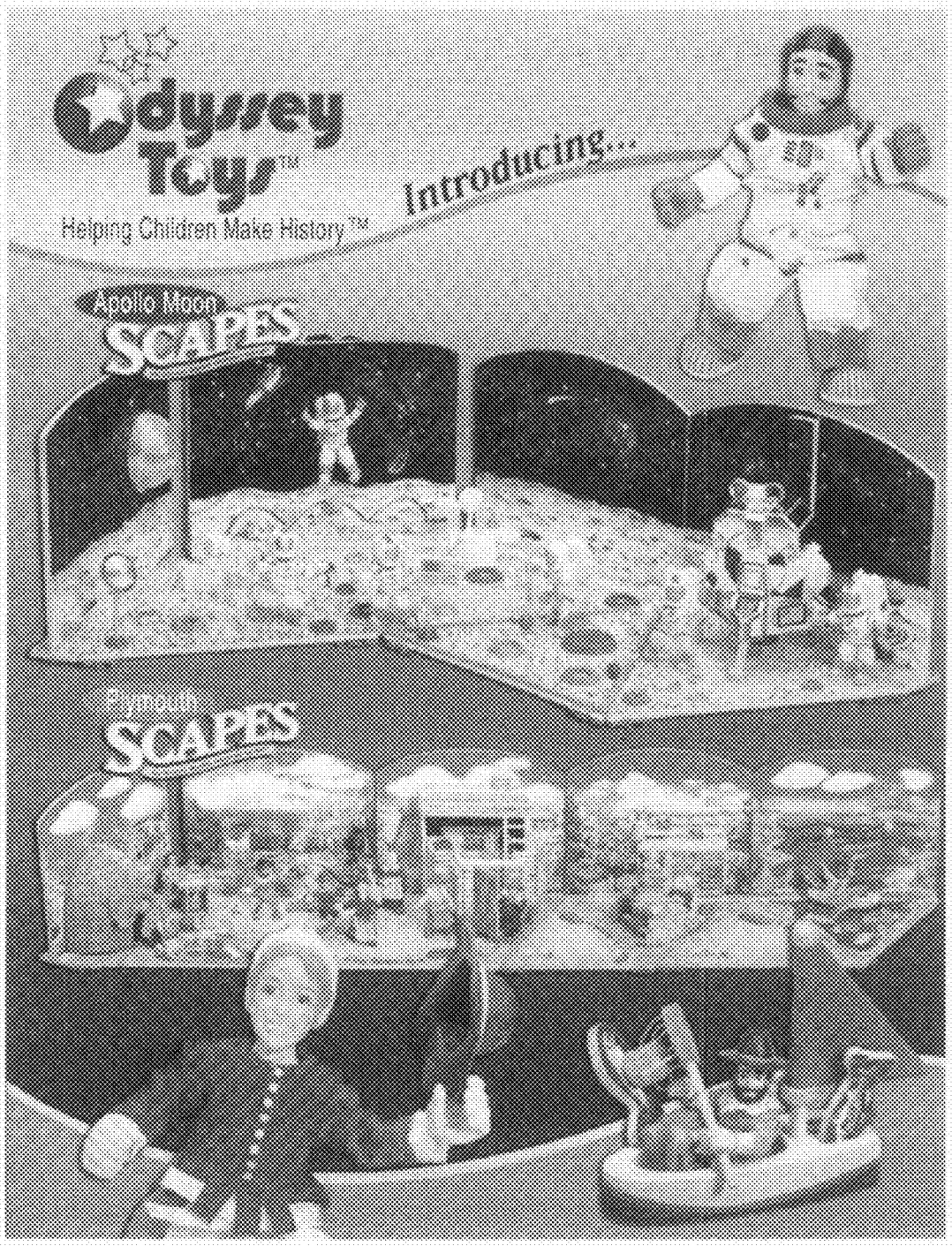
FIGS. 1-4 present example photostats containing assembled scenes and portions of Apollo Moon Scapes and Plymouth Scapes, in accordance with an embodiment of the present invention.
Figure 2:
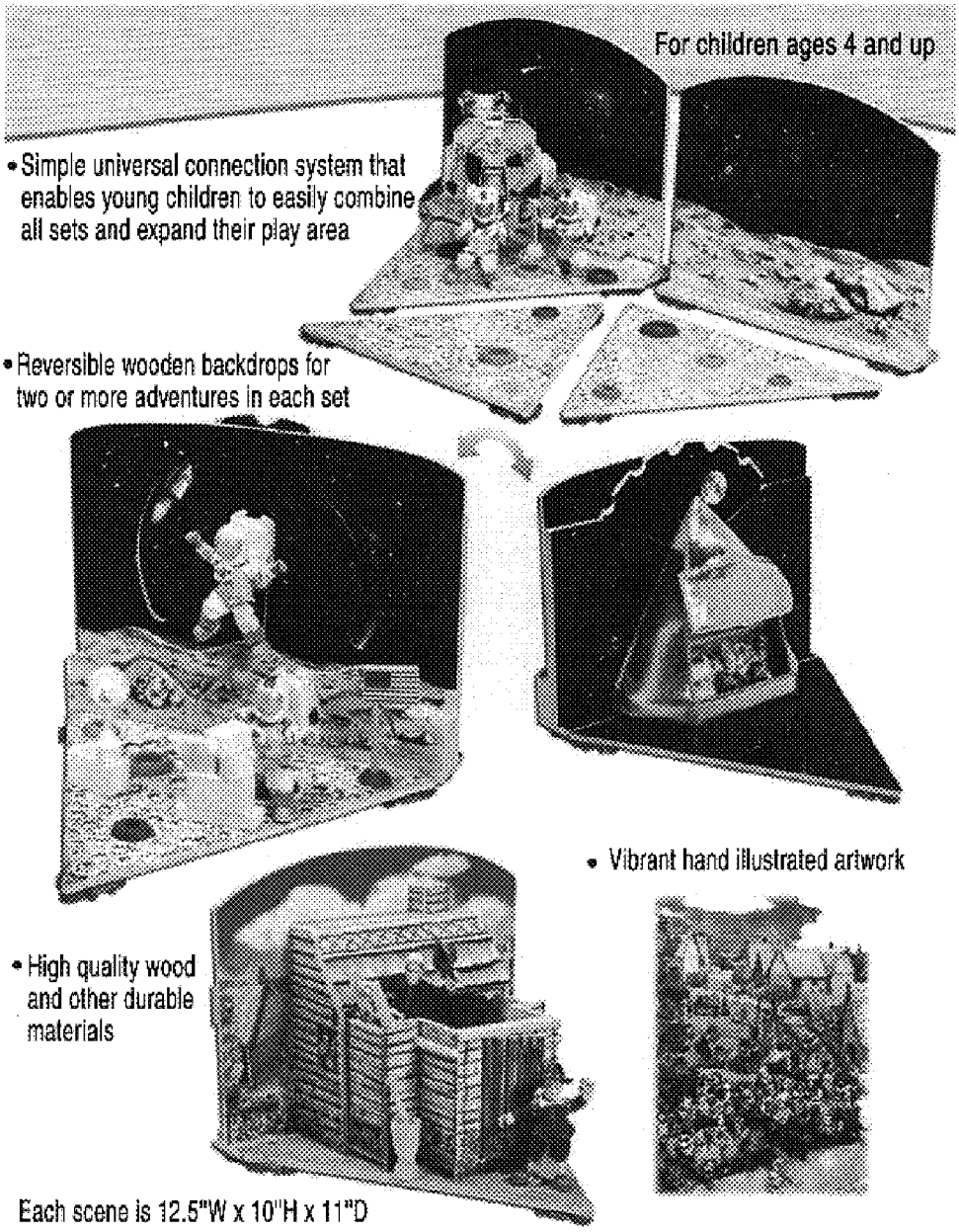
Figure 3:
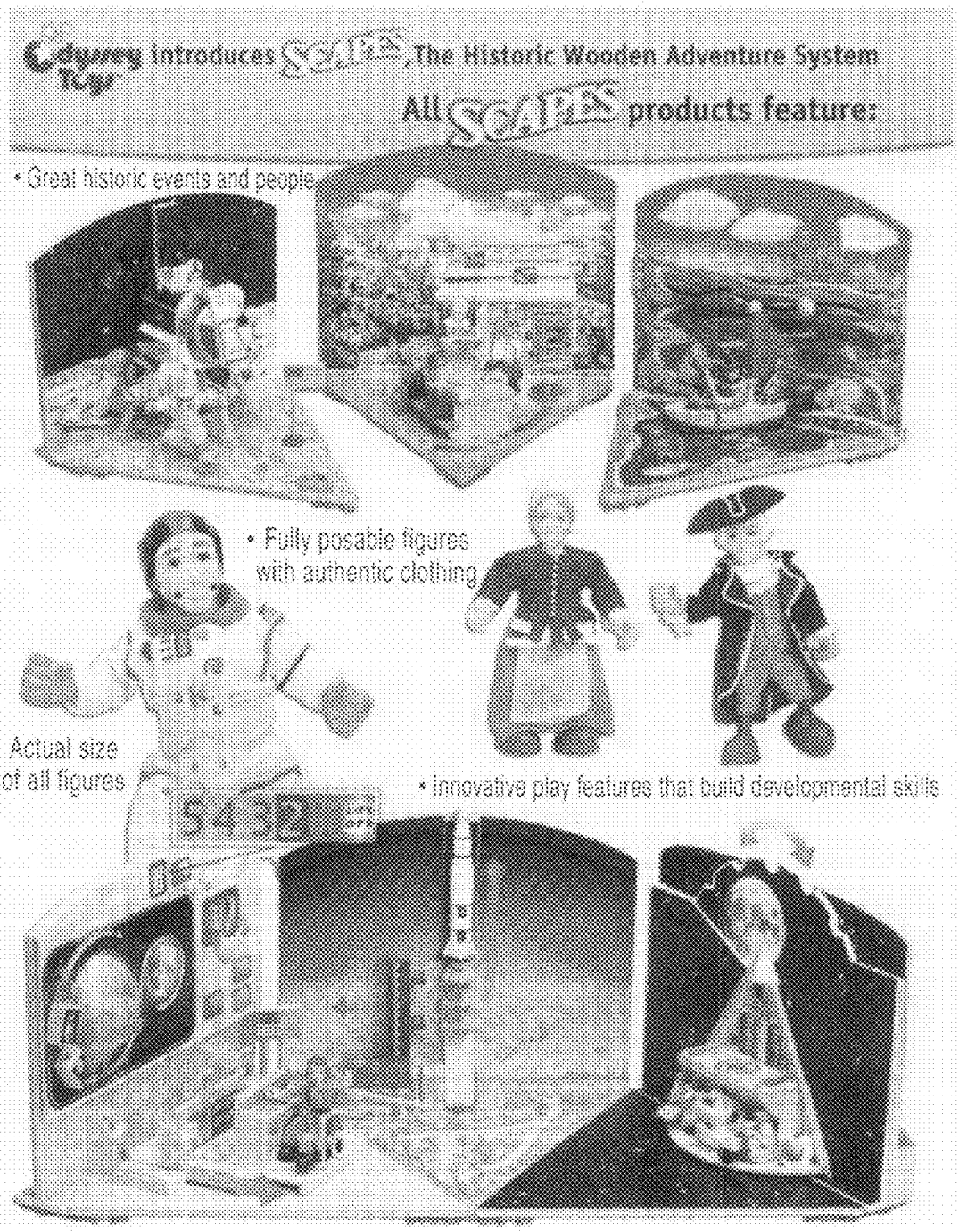
Figure 4:
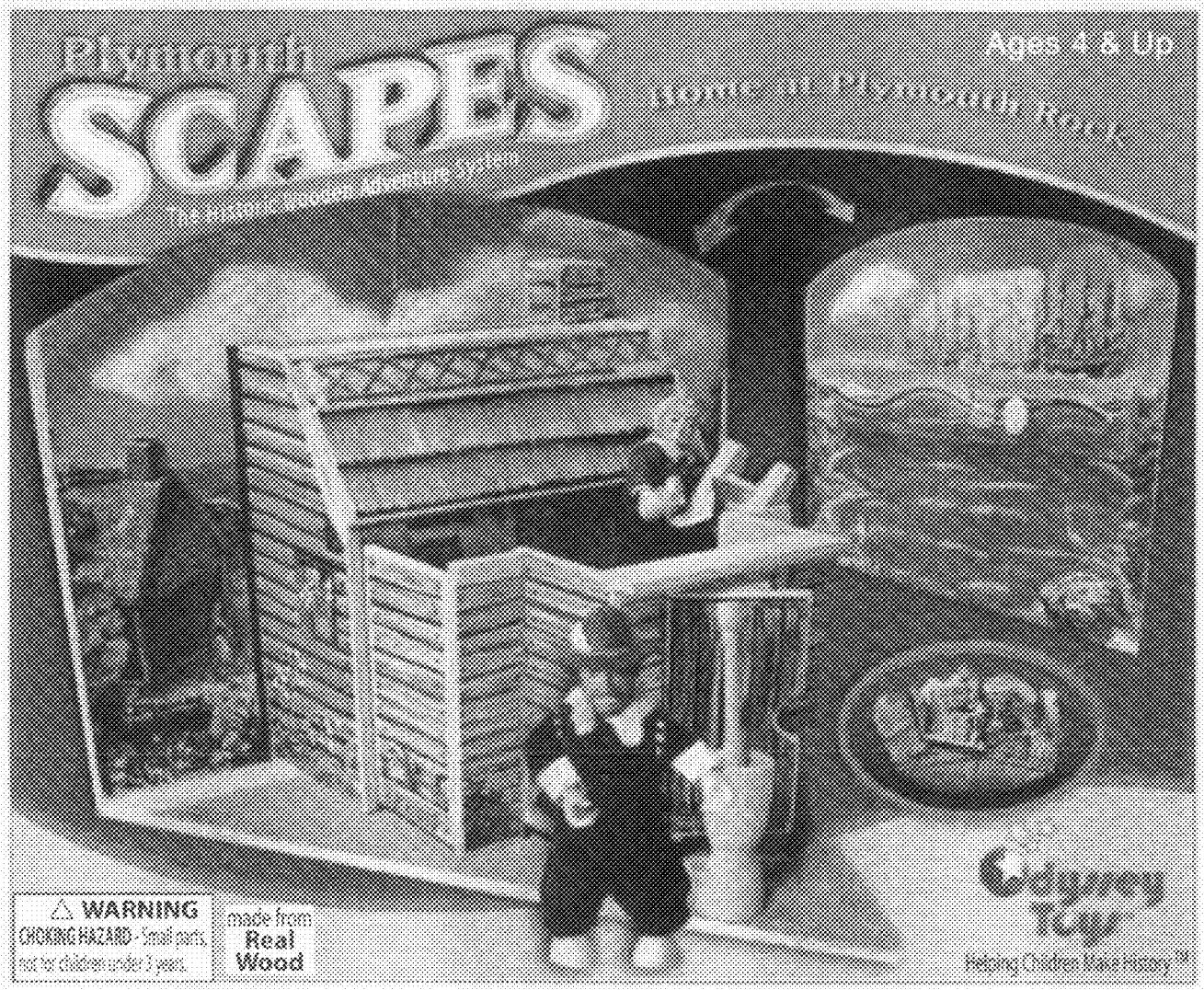
Figure 5:
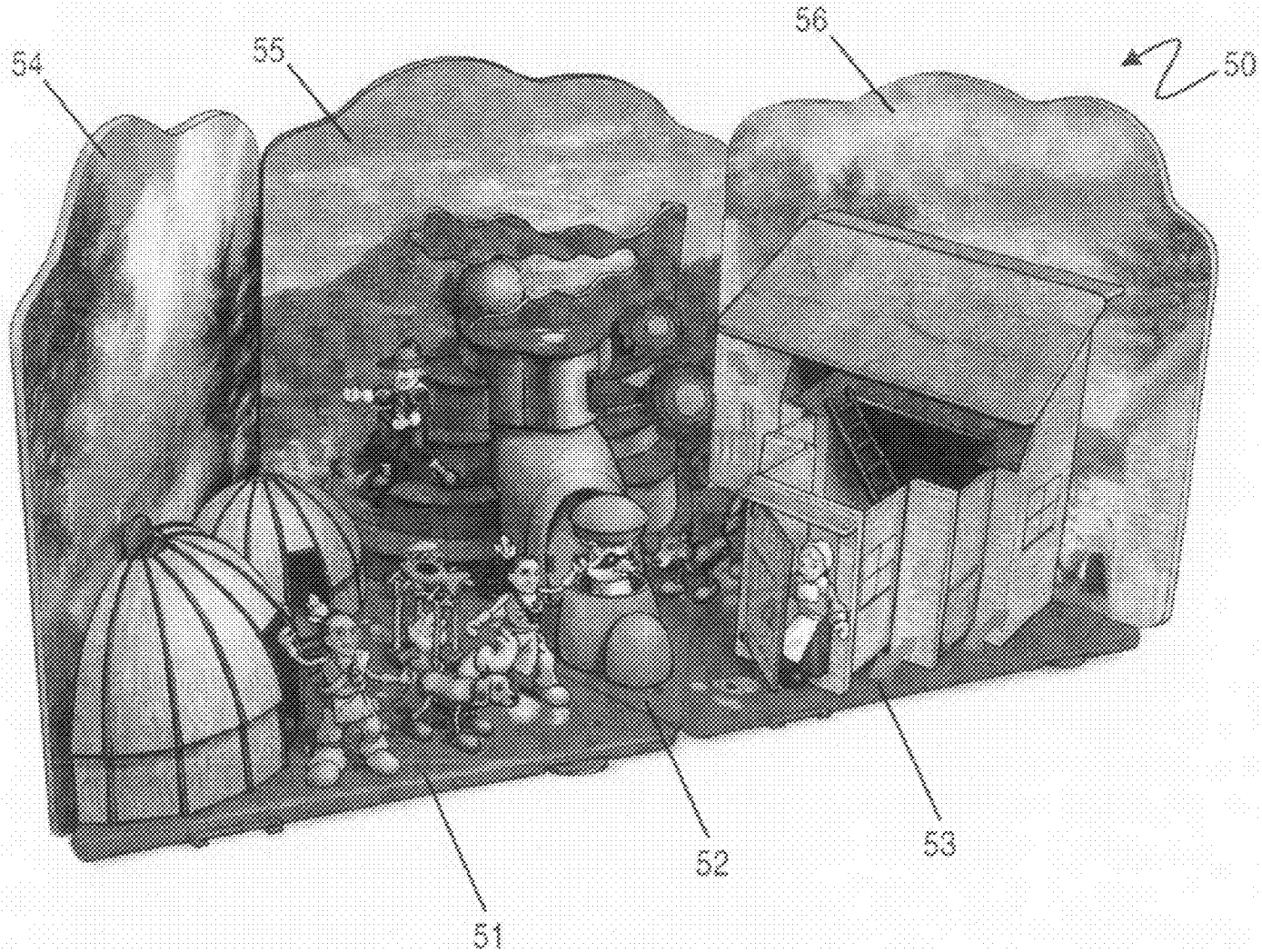
FIGS. 5-8 present various views of example Scapes, figures, and portions of Scapes, in accordance with embodiments of the present invention.
Figure 6:
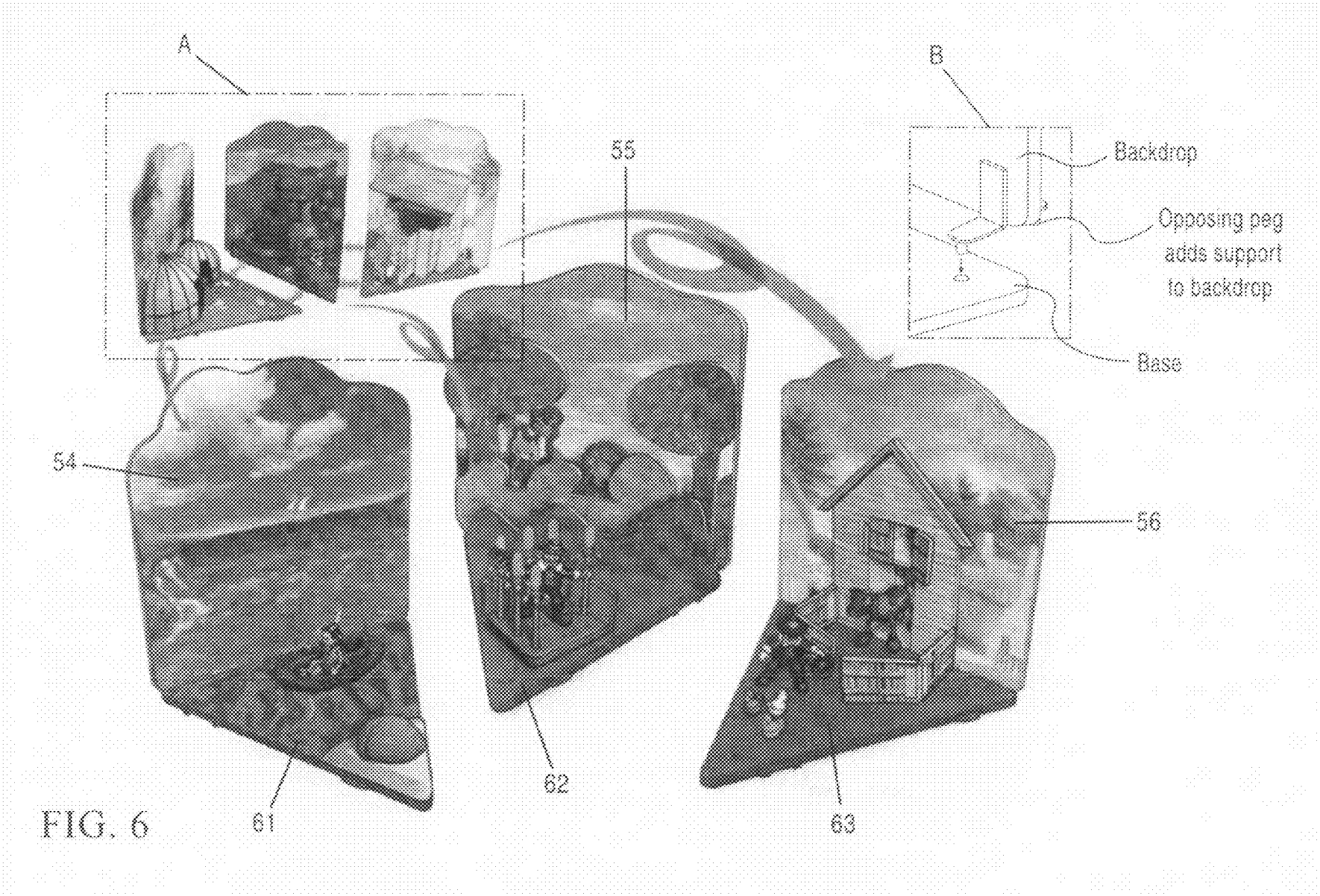
Figure 7:
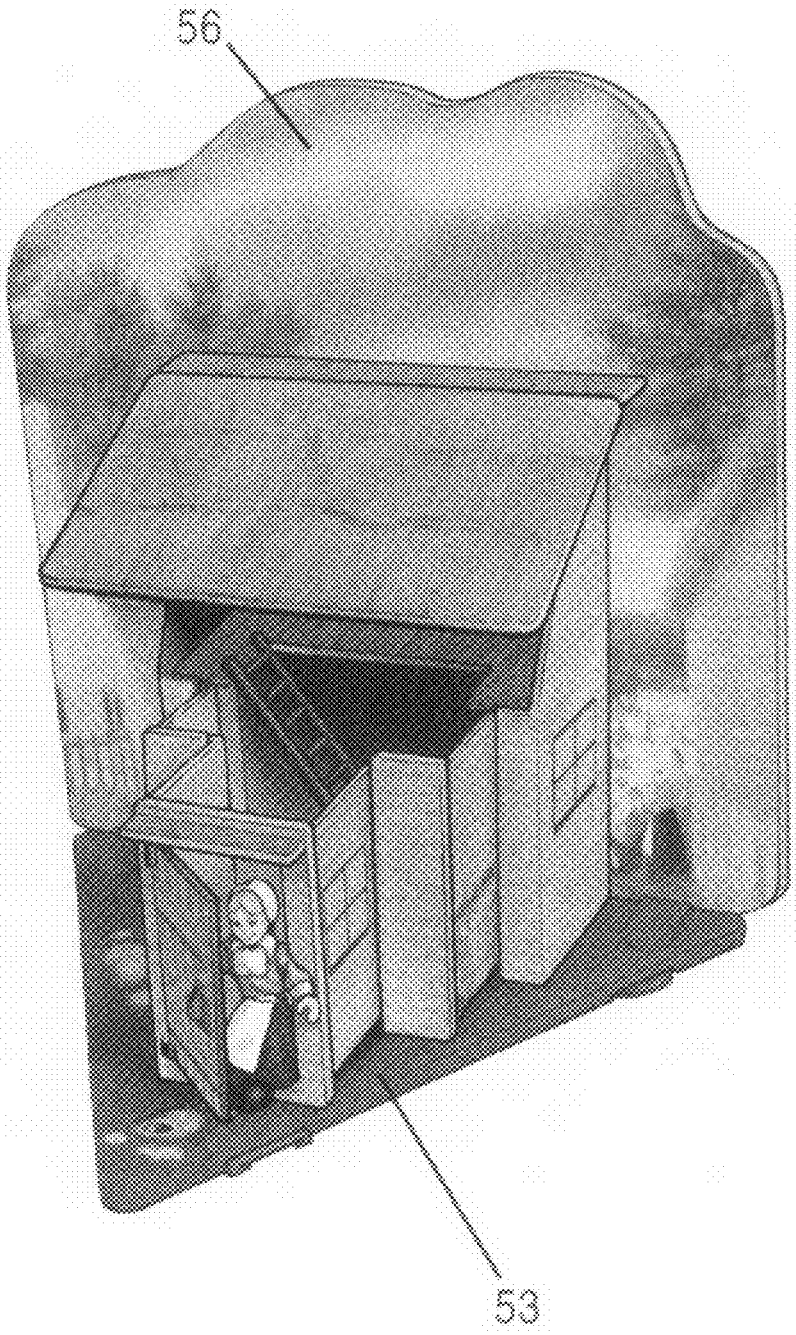
Figure 8:
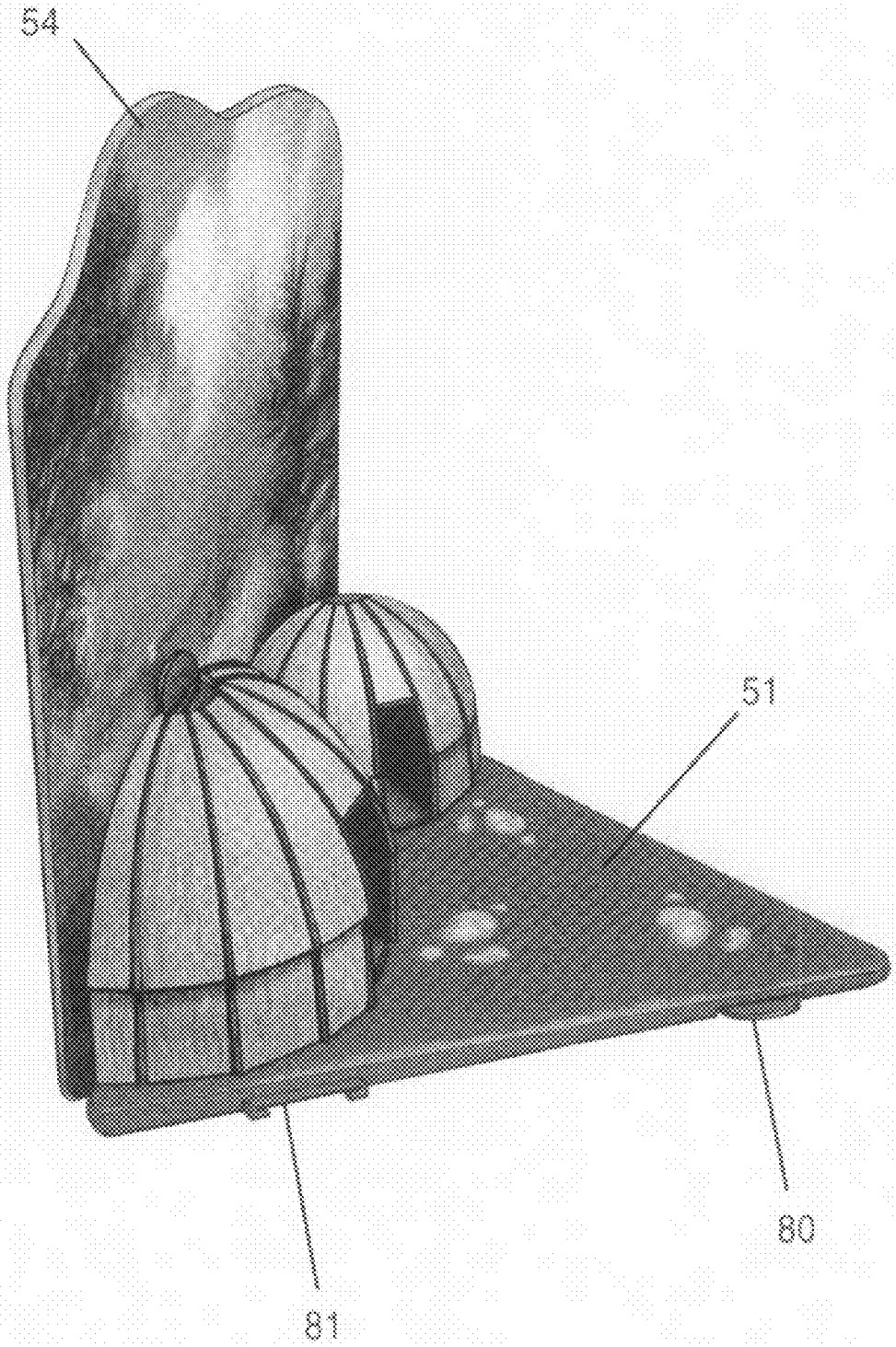

FIGS. 5-8 present various views of example Scapes, figures, and portions of Scapes, in accordance with embodiments of the present invention. FIG. 5, referred to as "presentation pilgrim . . . ", shows a full set up 50 of three two-piece sections 51, 52, 53, 54, 55, 56 assembled together (3 bases+3 backdrops). FIG. 6 shows an exploded view of the reverse side portions 54, 55, 56, 61, 62, 63 (with inset A showing first sides of bases and inset B showing a close-up of one variation of the connection method and system for the backdrops to the bases) for the assembled Scape 50 of FIG. 5 and closeups of assembly feature details. FIGS. 7 and 8 show closeups of example individual portions 53, 56 and 51, 54, respectively, of the presentation Scape 50 of FIG. 5. As shown, a user assembles the sections to make a larger scene. As most clearly shown in FIG. 8, in one embodiment, each side of the base 51 includes tab 80 and slot 81, features that allow universal connection of any one base 51 to any other base (e.g., base 53 shown in FIG. 7).

Figure 9:
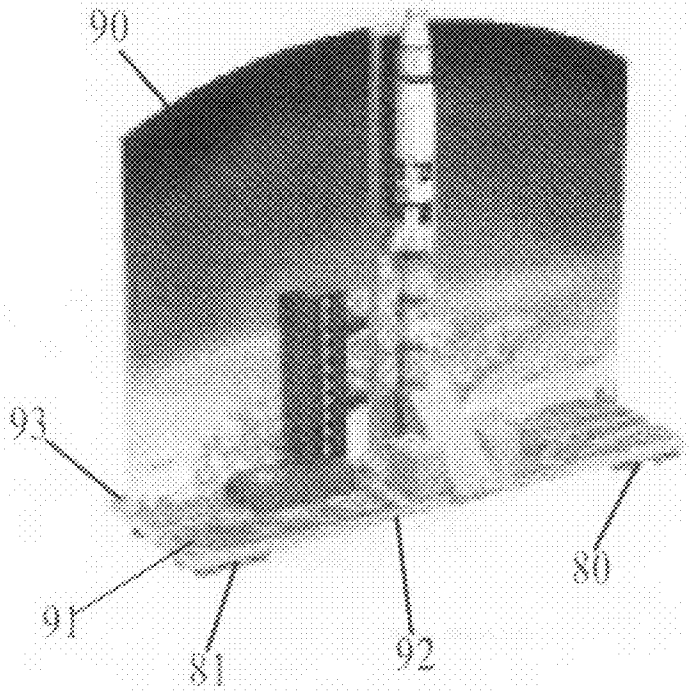
FIGS. 9 and 10 contain photostats of an example "T-shaped" backdrop and the backdrop connected to a base, respectively, in accordance with an embodiment of the present invention.
Figure 10:
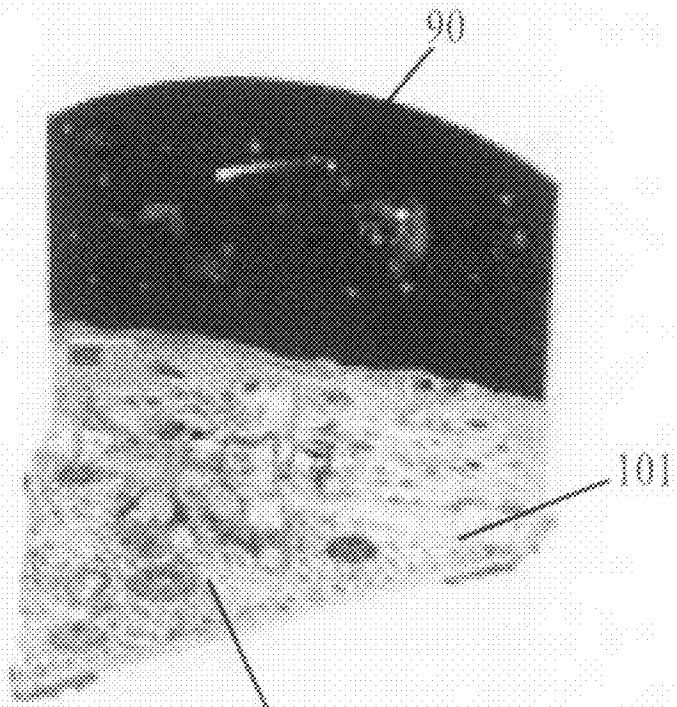

In one embodiment, as shown, for example, in FIG. 9, each backdrop 90 has a "T-shape" cross-section, formed in part by a backdrop bottom portion 91 and backdrop standing portion 92. A tab 80 and slot 81 are provided on each opposite edge 92, 93 of the backdrop bottom portion 91. Thus, as shown in FIG. 10, the backdrop 90 is connectable via either edge 92, 93 to any side of a base, such as to the side 101 of base 100. In the embodiment shown in FIGS. 9 and 10, the backdrop 92 is 2-sided, so the user can flip the backdrop around to vary scenes and/or play.

Figure 12:
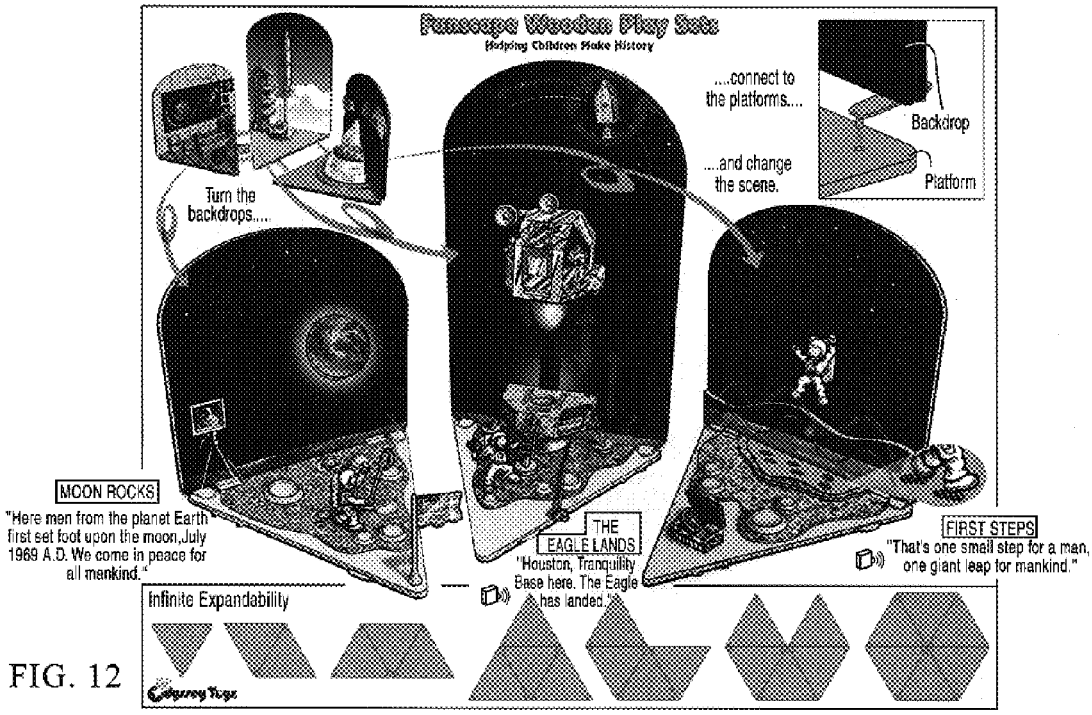

FIGS. 11 and 12 present a full setup and disassembled layout features, respectively, for example Apollo Moon Scapes, in accordance with an embodiment of the present invention.

Figure 13:
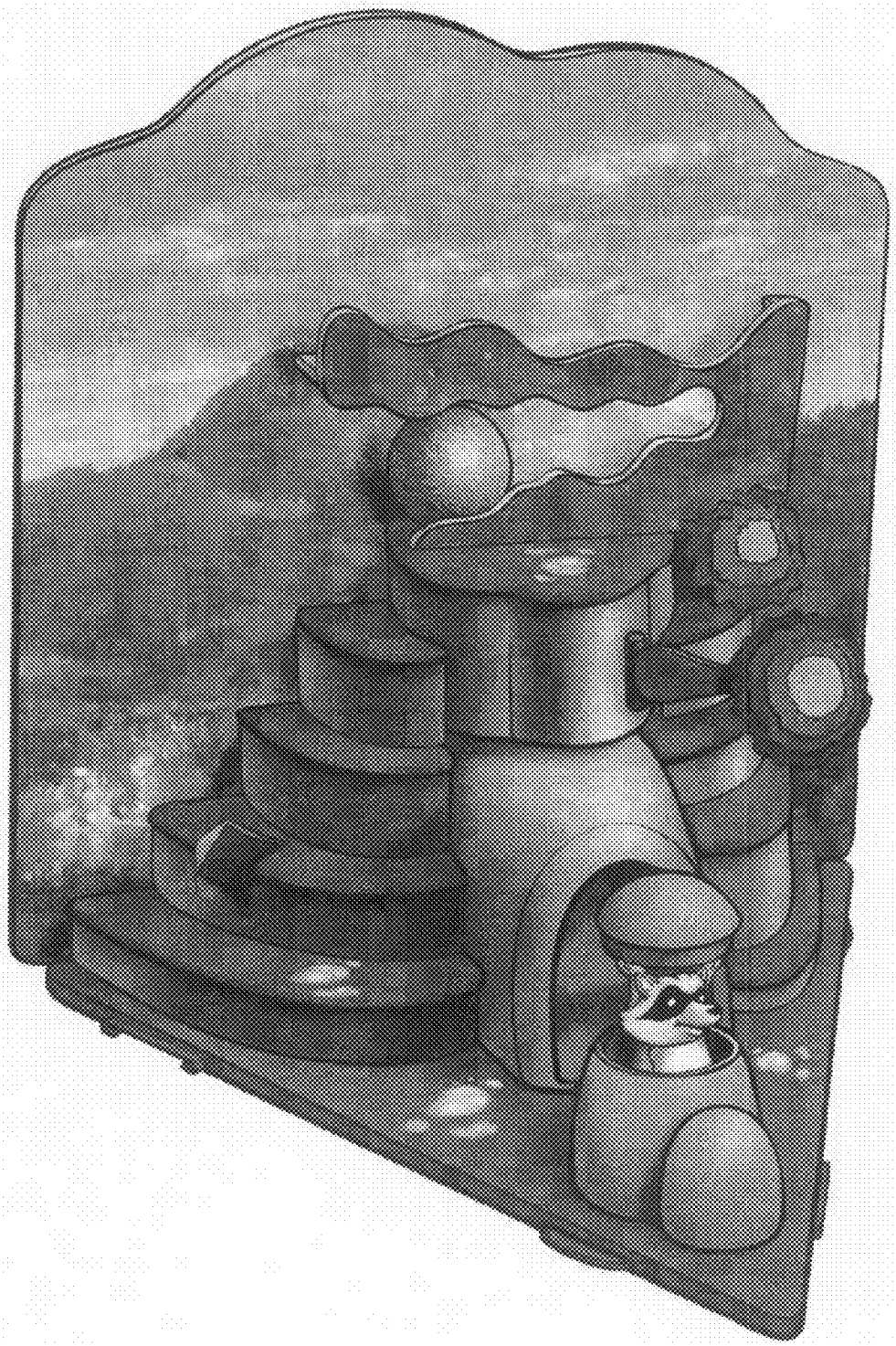
FIG. 13 shows another example individual portion of a layout, in accordance with an embodiment of the present invention.
Figure 14:
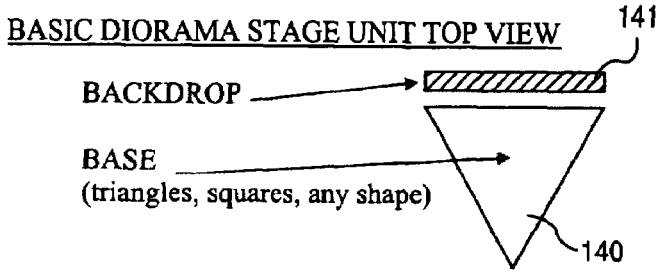
FIGS. 14-23 contain detail of various aspects and overhead views of example scape bases and backdrops, various example assembly layouts of Scapes scenes assembled from one or more of the bases and backdrops, as well as other features, in accordance with embodiments of the present invention.
Figure 15:
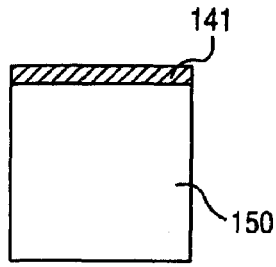
Figure 16:
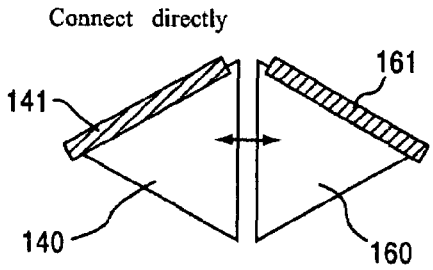
Figure 17:
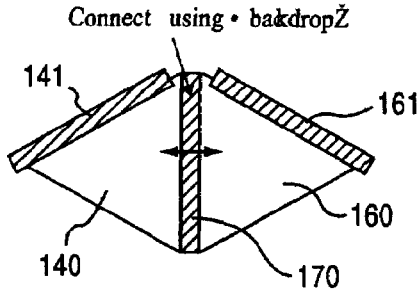
Figure 18:
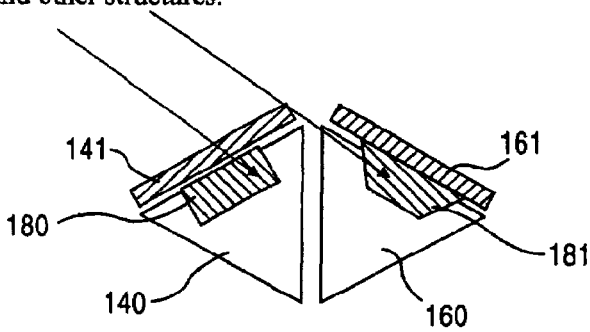
Figure 19:
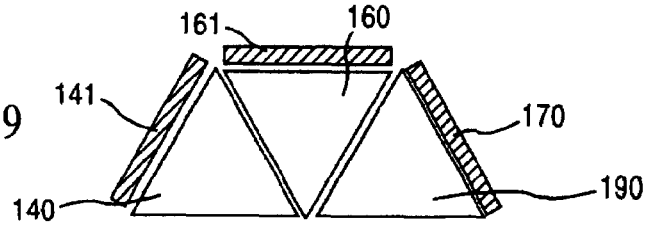
Figure 20:
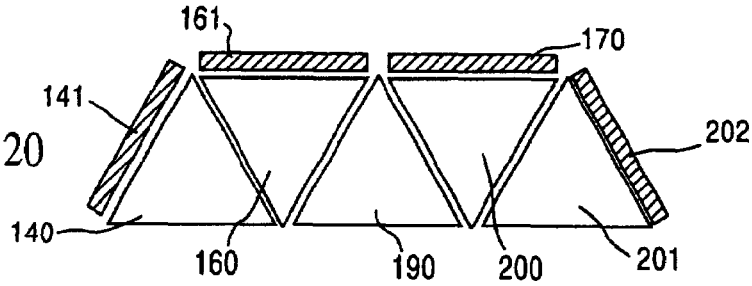
Figure 21:
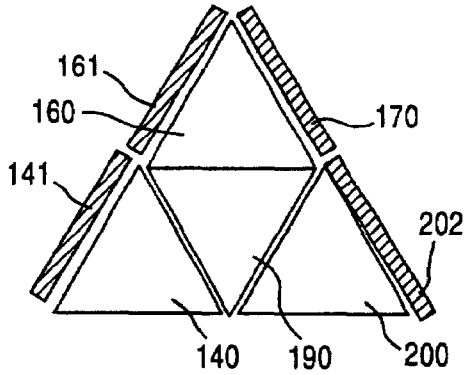
Figure 22:
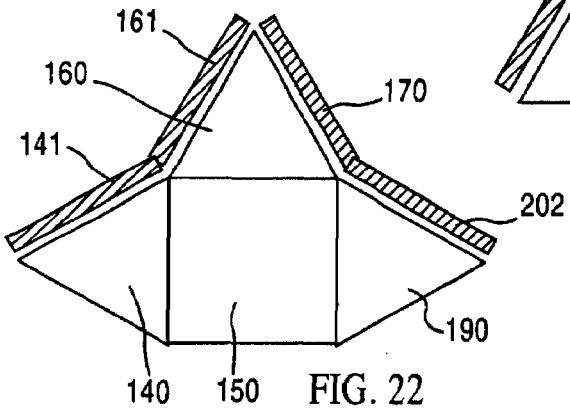
Figure 23:
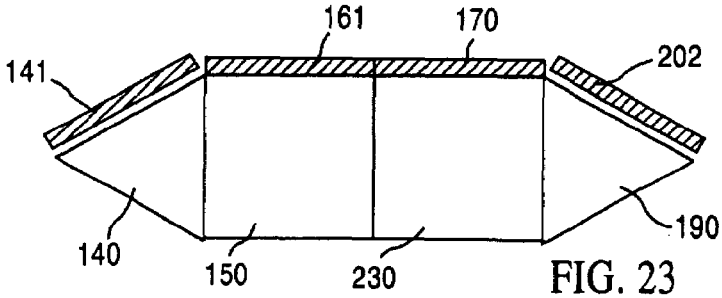

FIG. 13 shows another example individual portion of a layout, in accordance with an embodiment of the present invention.

Features of the assembleable sectioned portion of the Scapes of one embodiment of the present invention include one or more of the following: 1) wood (or plastic or other appropriate construction material) backdrops and play board bases; 2) toys optionally attached to backdrops and playboards, such as houses, ships, rockets, globes and other innovative play features; 3) a unique universal connection system—in one embodiment, backdrops and bases all connect using a male and female (e.g., tab and slot) connection system; bases connect to other bases, backdrops to other backdrops and backdrops to bases; 4) connectors are simple to use and allow universal connection of bases and backdrops; connector tabs have, for example, universally connectable male and female sides (e.g., spaced tab and slot pairs on each edge); each connector tab, for example, pushes into a corresponding slot; 5) in one embodiment, base sections are triangular, so that any way the bases are positioned, a connector male end always matches with a corresponding female; 6) bases can be other shapes, such as square, rectangular, pentagon shaped or hexagon shaped, without departing from the scope of the invention; 7) in one embodiment, backdrops have rectangular bottom portions and curved backdrop standing portions with opposite male and female connectors, but the backdrops could be other shapes without departing from the scope of the present invention; 8) various types of connectors (rather than tabs and slots) are also usable with the present invention, such as magnets, peg and holes, and hooks and loops; 9) the bases and backdrops of the present invention are also usable without any connectors; in one variation, the bases and backdrops are simply placed adjacent to one another so as to line up and form scenes; in another variation, the bases and backdrops have extending and receiving features, similar to how puzzle pieces fit together; 10) the system is fully expandable; there is no limit to how large or wide a scene can grow with more and more backdrops and bases; 11) in one embodiment, backdrops are all reversible and two sided, with artwork and toy features attached to both sides; users can thus play with both sides; in another embodiment, sections are one sided; and 12) in one embodiment, decoration artwork includes bare wood (or other construction material) parts, or parts painted or covered with labels.

FIGS. 14-23 contain detail of various aspects and overhead views of example scape bases and backdrops 140, 141, 150, 160, 161, 170, 200, 201, 202, 230, various example assembly layouts of Scapes scenes assembled from one or more of the bases and backdrops 140, 141, 150, 160, 161, 170, 200, 201, 202, 230, as well as other features 180, 181, in accordance with embodiments of the present invention.

The posable figures, in accordance with one embodiment of the present invention, include the following features: 1) approximately 4" tall (or other appropriate height given scale of bases and backdrops); 2) plastic (or other suitable material of construction) bendable arms and legs for full posability; in one embodiment, the limbs have a flexible outer surface, such as soft plastic, and an inner stiffening, bendable, and shape retaining frame, such as wire or other metal, to allow the limbs to be placed in and retain shape in a wide range of bent positions; 3) head that rotates left and right; 4) a uniquely designed hard plastic (or other suitable material) torso that locks the bendable limbs in place; 5) sewn clothing—clothing may or may not be removable from figures; 6) hands that grip; 7) realistic heads; 8) removable plastic hats, backpacks and other accessories; 9) capability for figures to stand easily on their own due, for example, to extra large feet; capability to balance on one foot when positioned correctly; 10) capability of hands to grip objects; and 11) figures are based, for example, on great historic people, but design is usable for any person, character, or animal.

Figure 25:
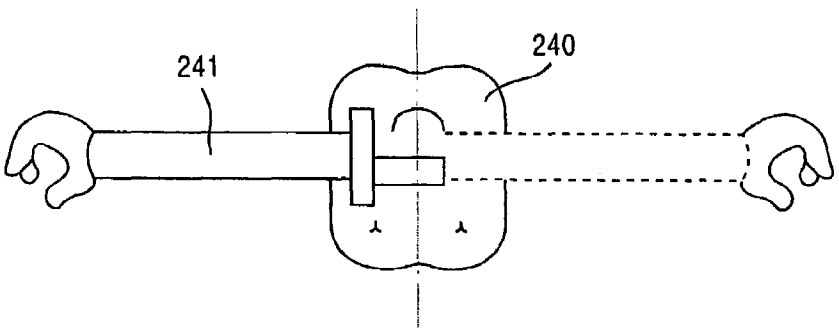
FIGS. 24-26 show front, overhead, and side views, respectively, of portions of a figure having an arm connected via a post and leg connected via a flange and opening in the torso, in accordance with an embodiment of the present invention.
Figure 24:
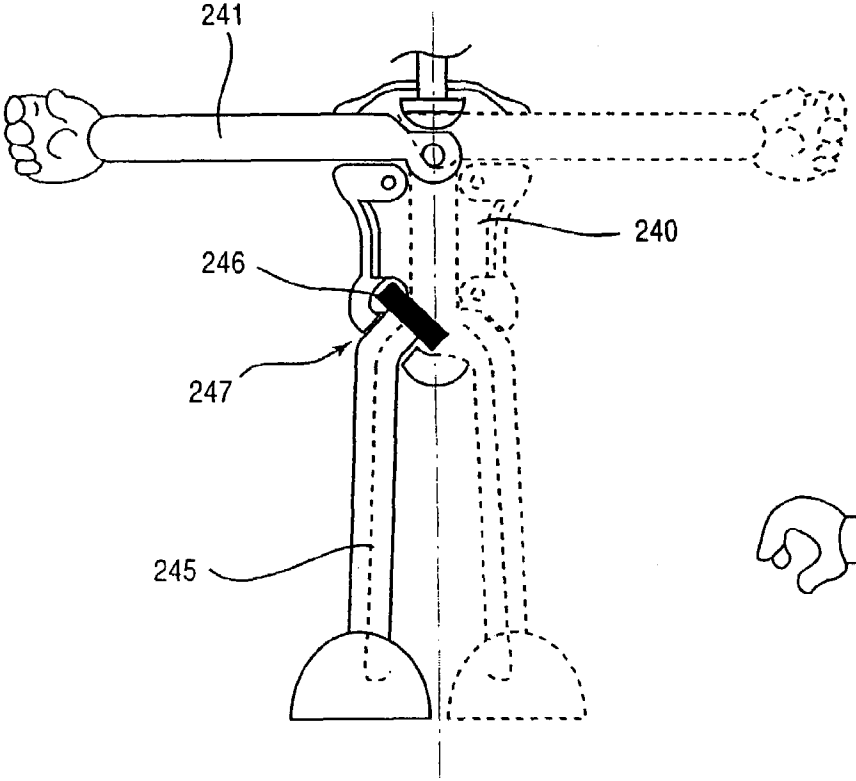
Figure 27:
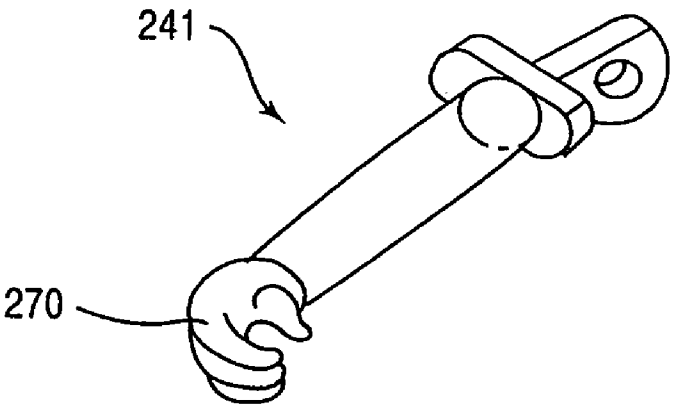
FIG. 27 presents a closeup of an arm with a gripping hand, in accordance with an embodiment of the present invention.
Figure 26:
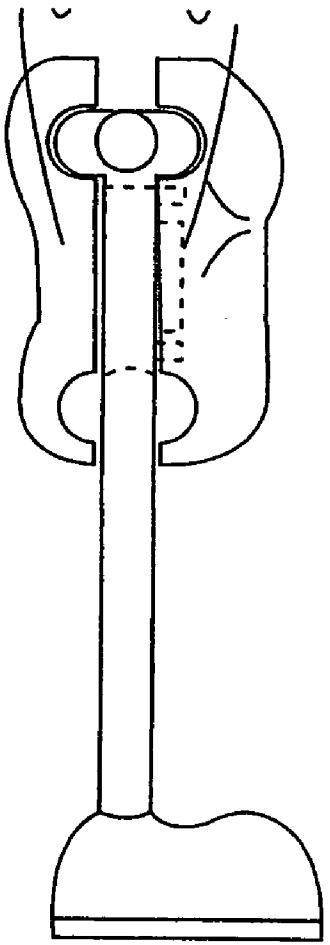
Figure 29:
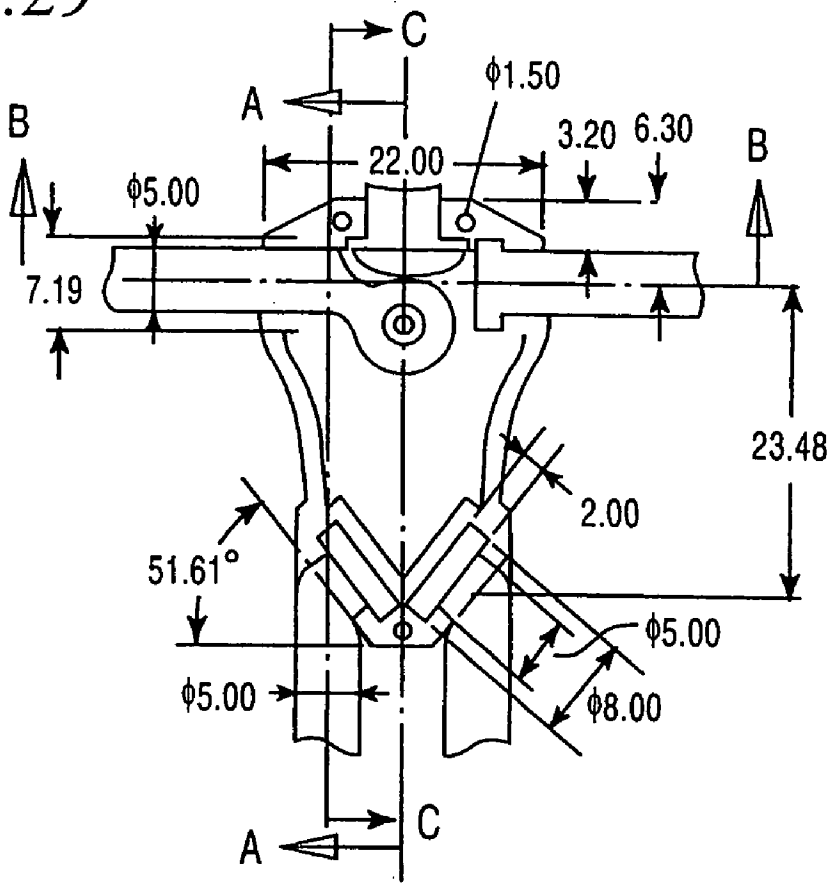
FIGS. 28-31 contain various details, including dimensions for example figures, in accordance with one embodiment of the present invention.
Figure 28:
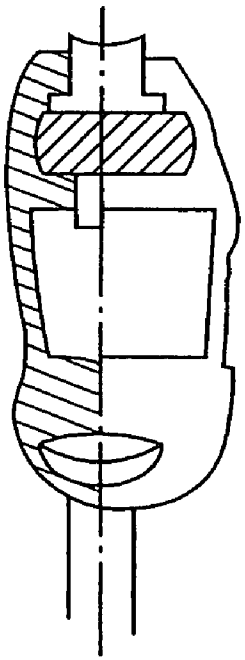
Figure 31:
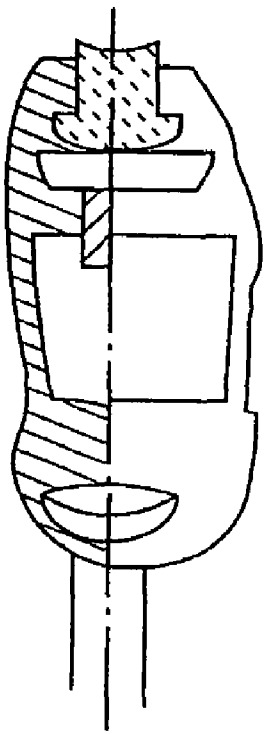
Figure 30:
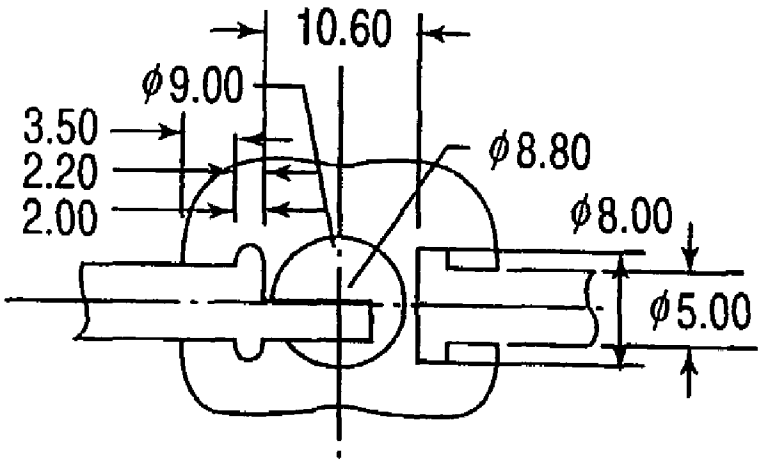
Figure 32:
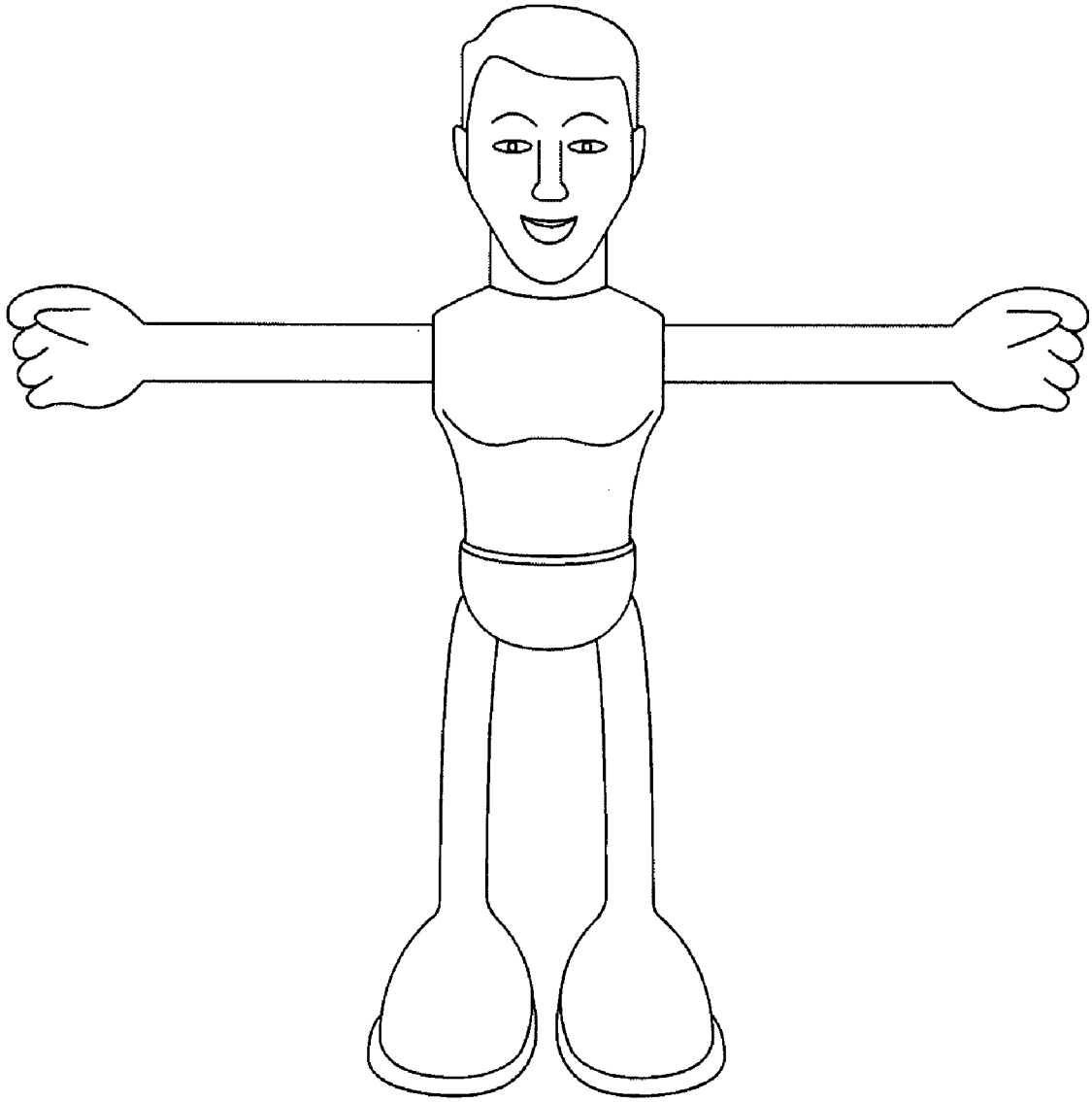
FIGS. 32-36 present various photostats of an assembled and partially assembled figure, in accordance with another embodiment of the present invention, in which two posts are used to connect the arms and the legs.
Figure 33:
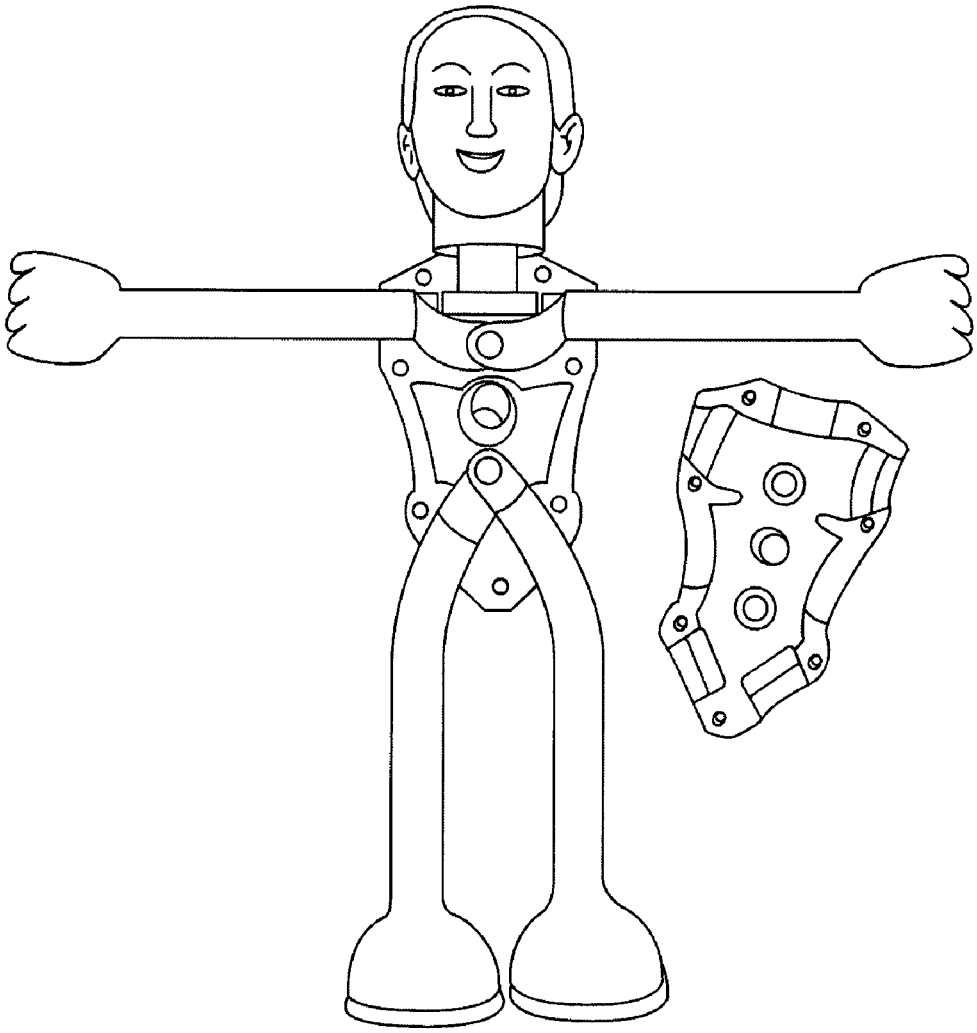
Figure 34:
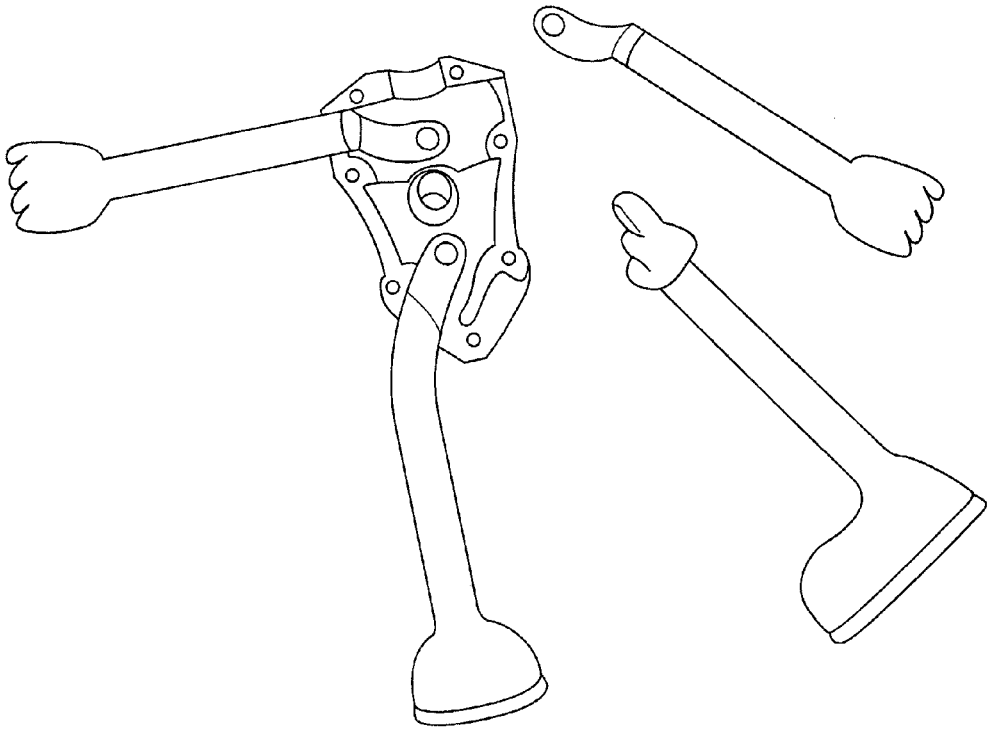
Figure 35:
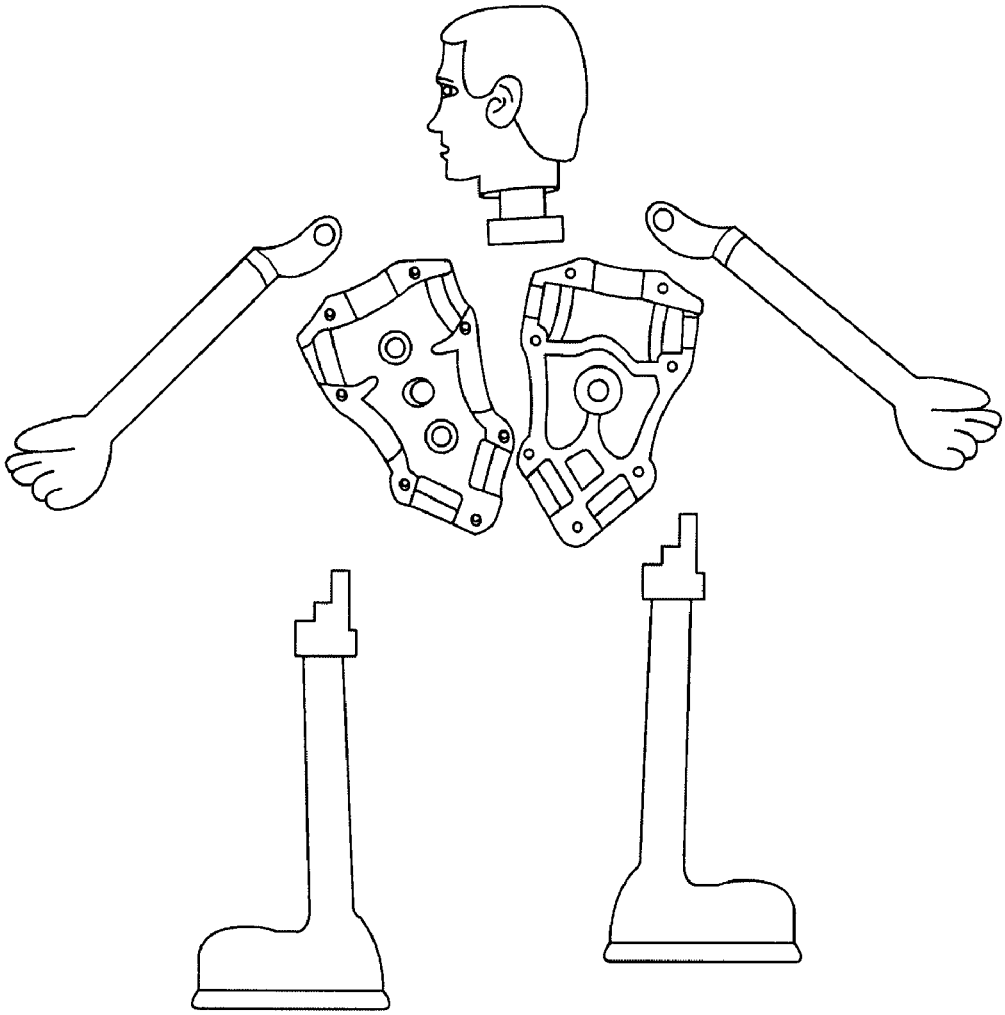
Figure 36:
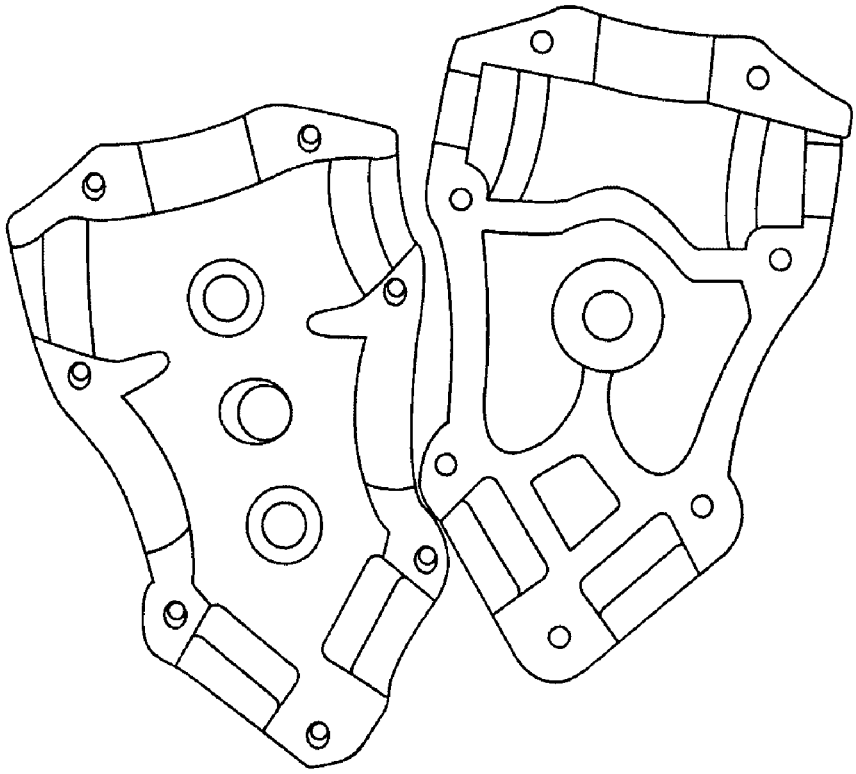

In embodiments of the present invention, as shown in FIGS. 24-36, limbs are locked into a two part torso with using a loop or other opening at end of limbs and locking peg inside torso. Torso is assembled with limbs held inside by pressing together the two halves. FIGS. 24-26 show front, overhead, and side views, respectively, of a first half of a torso 240 with an arm 241 having an inner stiffening, bendable, and shape retaining frame 242, such as wire or other metal, and an outer surface, such as soft plastic. The leg 245 similarly includes an inner frame 245*a* and an outer surface 245*b*. The arm 241 is connected to the torso 240 via a post 244, and the leg 245 is connected to the torso 240 via flange 246 and opening 247 in torso 240. FIG. 27 presents a closeup of the arm 241 with gripping hand 270. FIGS. 28-31 contain additional details, including dimensions for example figures, in accordance with one embodiment of the present invention. FIGS. 32-36 present various photostats of an assembled and partially assembled figure, in accordance with another embodiment of the present invention, in which two posts are used to connect the arms and the legs.

Figure 37:
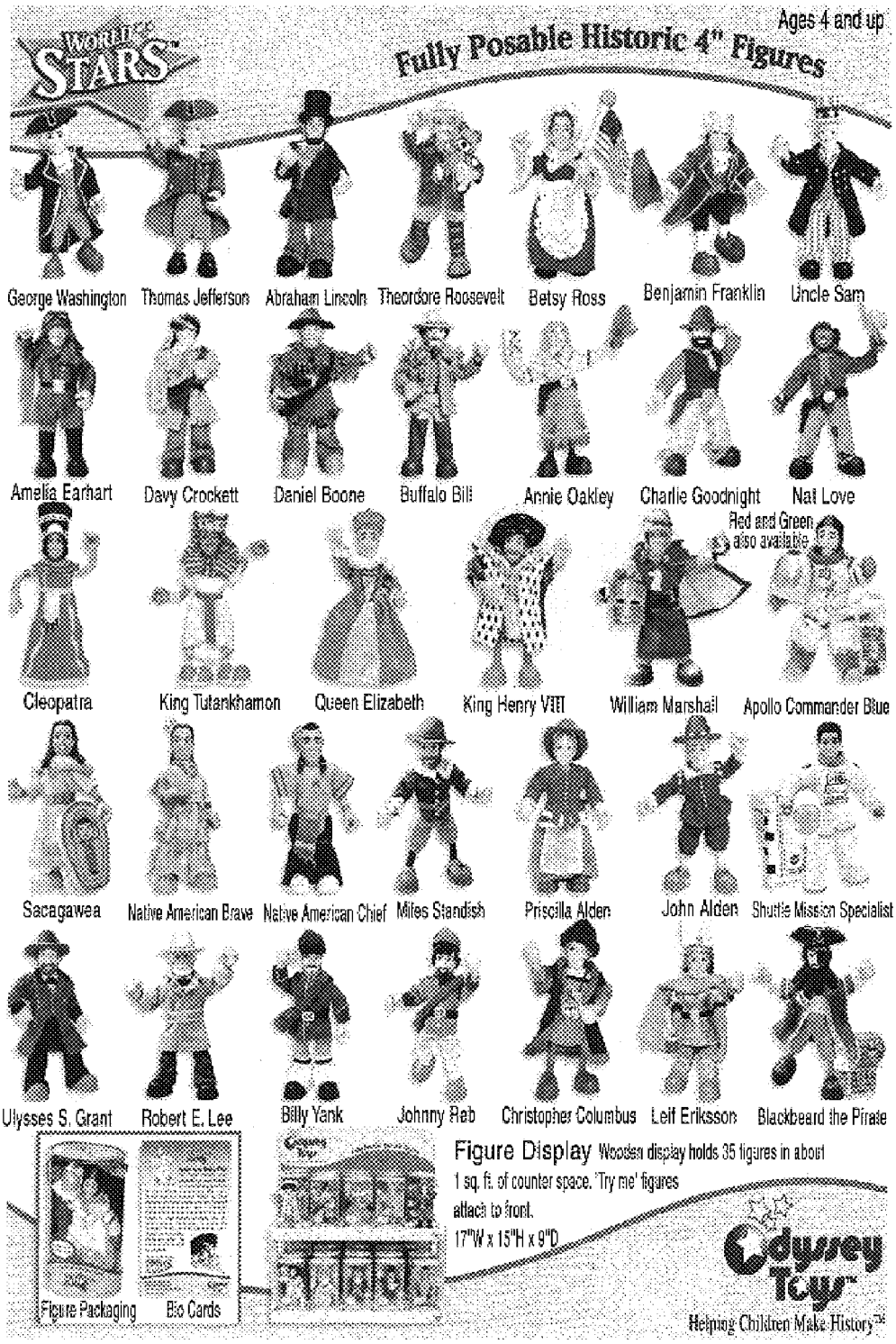
FIG. 37 shows a photostat of a wide variety of sample figures, in accordance with an embodiment of the present invention.

FIG. 37 shows a photostat of a wide variety of sample figures, in accordance with an embodiment of the present invention.

Figure 38:
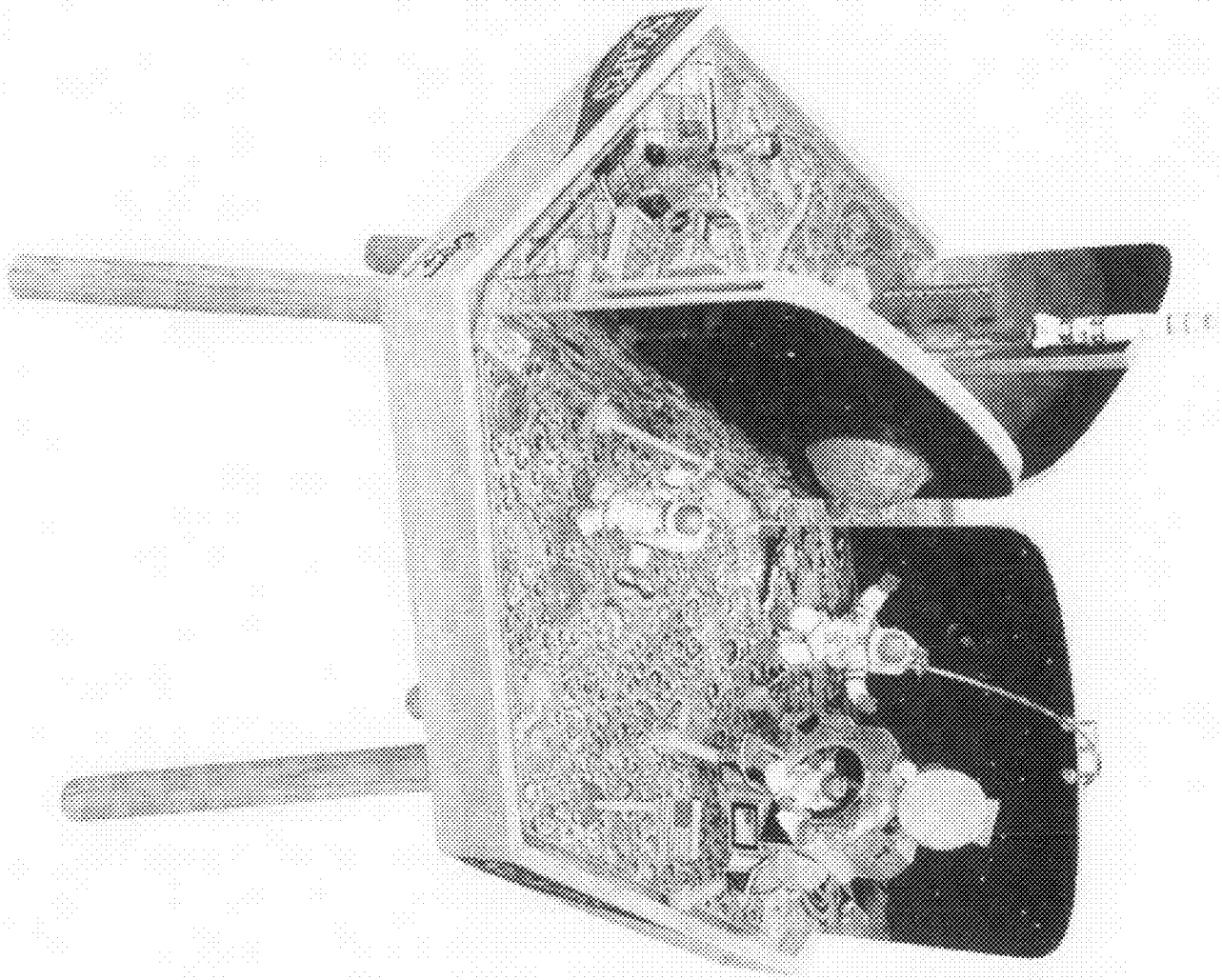
FIG. 38 shows a photostat of a sample display table for displaying an assembled Scapes set, in accordance with an embodiment of the present invention.

FIG. 38 shows a photostat of a sample display table for displaying an assembled Scapes set, in accordance with an embodiment of the present invention.

Example embodiments of the present invention have now been described in accordance with the above advantages. It will be appreciated that these examples are merely illustrative of the invention. Many variations and modifications will be apparent to those skilled in the art.

What is claimed is:

1. An interconnectable play scenes system, comprising:

a first play scenes unit, the first play scenes unit being capable of independently freestanding; and a second play scenes unit, the second play scenes unit being capable of independently freestanding and capable of interconnecting with the first play scenes unit via an intermediate base unit;

wherein each of the first play scenes unit and the second play scenes unit include:

a base portion having a first interconnectable edge;

a backdrop fixably connected to the base portion, the backdrop having a first interconnectable edge on the base portion; and an interconnection mechanism on the first interconnectable edge of the base portion; and wherein the first play scenes unit and the second play scenes unit both individually and when connected together via the intermediate base unit form three dimensional and rearrangeable play scenes.

2. The unit of claim 1, wherein the base portion has a first interconnectable edge, a second interconnectable edge, and a third interconnectable edge.

3. The unit of claim 1, wherein the base portion has a generally rectangular cross-sectional shape.

4. The unit of claim 1, wherein the base portion has a base planar axis, wherein the backdrop has a backdrop planar axis, and wherein the base planar axis and the backdrop planar axis are approximately perpendicular.

5. The unit of claim 1, wherein each interconnection mechanism includes at least one selected from a group consisting of an extending tab and a slot for receiving the extending tab.

6. The unit of claim 1, wherein the interconnection mechanism is selected from a group consisting of one or more magnets, a peg and hole, and a hook and loop.

7. An interconnectable play scenes system, comprising:

a first base portion having at least two interconnectable edges, wherein an interconnection mechanism is fixed to each of the at least two interconnectable edges of the first base portion;

a first backdrop portion fixably attached to the base portion, the first backdrop portion having a planar surface, the first base portion extending approximately perpendicularly to the planar surface of the first backdrop portion;

a second base portion having an interconnectable edge, wherein an interconnection mechanism is fixed to the interconnectable edge of the second base portion;

a second backdrop portion fixably attached to the second base portion, the second backdrop portion having a planar surface, the second base portion extending approximately perpendicularly to the planar surface, wherein an interconnection mechanism is fixed to the first interconnectable edge of the backdrop; and a base unit having at least two edges, each of the at least two edges of the base portion having an interconnection mechanism;

wherein the first base portion is connectable to the second base portion via the base unit in a first orientation, and wherein the first backdrop portion abuts the second backdrop portion in the first orientation so as to form a first two-walled play scene; and wherein the first base portion is connectable to the second base portion via the base unit in a second orientation, and wherein the first backdrop portion abuts the second backdrop portion in the second orientation so as to form a second two-walled play scene.

8. The system of claim 7, wherein, in the first orientation, a first one of the at least two interconnectable edges of the first base portion is connected to a first one of the at least two edges of the base unit, and wherein a first one of the at least two interconnectable edges of the second base portion is connected to a second one of the at least two edges of the base unit.

9. The system of claim 7, wherein, in the second orientation, the first one of the at least two interconnectable edges of the first base portion is connected to a second one of the at least two edges of the base unit, and a second one of the at least two interconnectable edges of the second base portion is connected to the first one of the at least two interconnectable edges of the base unit.

10. A rearrangeable play scenes system, comprising:

a first base portion having at least two fittable edges;

a backdrop having a planar surface and a first fittable edge extending approximately perpendicularly to the planar surface, wherein the fittable edge of the backdrop is fittably usable with each of the at least two fittable edges of the first base portion; and a second base portion having a fittable edge;

wherein the first base portion, the second base portion, and the backdrop are fittable in a first orientation so as to form a first play scene; and wherein the first base portion, the second base portion, and the backdrop are fittable in a second orientation so as to form a second play scene.

11. The system of claim 10, wherein each of the fittable edges of the first base portion, the backdrop, and the second base portion include extending features and corresponding receiving features for receiving the extending features.

* * * * *